US007931034B2

(12) United States Patent
Mack et al.

(10) Patent No.: US 7,931,034 B2
(45) Date of Patent: Apr. 26, 2011

(54) SPRAY ARM BEARING AND DISHWASHER WITH A SPRAY ARM ARRANGEMENT

(75) Inventors: Friedrich Mack, Nuremberg (DE); Wolfgang Schmidt, Engelthal (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 569 days.

(21) Appl. No.: 11/718,107

(22) PCT Filed: Sep. 13, 2005

(86) PCT No.: PCT/EP2005/009802

§ 371 (c)(1),
(2), (4) Date: Mar. 14, 2008

(87) PCT Pub. No.: WO2006/048074

PCT Pub. Date: May 11, 2006

(65) Prior Publication Data

US 2009/0145981 A1 Jun. 11, 2009

(30) Foreign Application Priority Data

Oct. 29, 2004 (DE) ..... 10 2004 053 143

(51) Int. Cl.
*B08B 3/12* (2006.01)
*B08B 6/00* (2006.01)

(52) U.S. Cl. ..... 134/176; 239/264; 239/259; 239/251; 239/261; 137/180; 137/181; 134/179; 134/172

(58) Field of Classification Search ..... 239/261, 239/264, 251, 259
See application file for complete search history.

(56) References Cited

U.S. PATENT DOCUMENTS

| | | | | |
|---|---|---|---|---|
| 3,599,872 | A | 8/1971 | Guth | |
| 4,869,428 | A | 9/1989 | Gombar | |
| 5,211,190 | A * | 5/1993 | Johnson et al. | 134/180 |
| 5,673,716 | A * | 10/1997 | Gurubatham et al. | 134/111 |
| 6,371,138 | B1 * | 4/2002 | Kamoto et al. | 134/172 |
| 2005/0241681 | A1 * | 11/2005 | Hwang | 134/56 D |
| 2006/0108454 | A1 * | 5/2006 | Eichholz | 239/562 |

FOREIGN PATENT DOCUMENTS

| | | |
|---|---|---|
| DE | 12 69 778 | 6/1968 |
| NL | 6 811 337 | 2/1970 |

OTHER PUBLICATIONS

Patent Abstracts of Japan, BD. 2000, Nr. 13, Feb. 5, 2001 & JP 2000 287905, Sanyo Electric Co., Ltd., Oct. 17, 2000.
International Search Report (PCT/EP2005/009802) dated Dec. 20, 2005.

* cited by examiner

*Primary Examiner* — Dinh Q Nguyen
*Assistant Examiner* — James S Hogan
(74) *Attorney, Agent, or Firm* — Pearne & Gordon LLP

(57) ABSTRACT

The invention relates to a spray arm bearing (1) with a bearing element (2), for mounting a spray arm (20) and a flow-guide device (3), connected to the bearing element (2), whereby the bearing element (2) comprises a through opening for the passage of fluid. According to the invention, the base area (D2) of the flow-guide device (3) corresponds to the base area (D1) of the through opening or lies within the base area (D1) of the through opening.

11 Claims, 1 Drawing Sheet

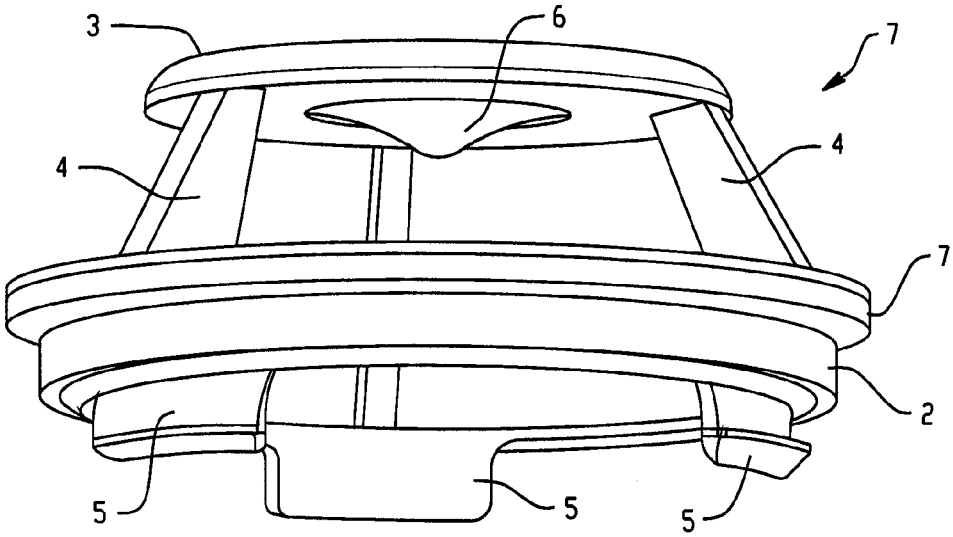
Fig. 1
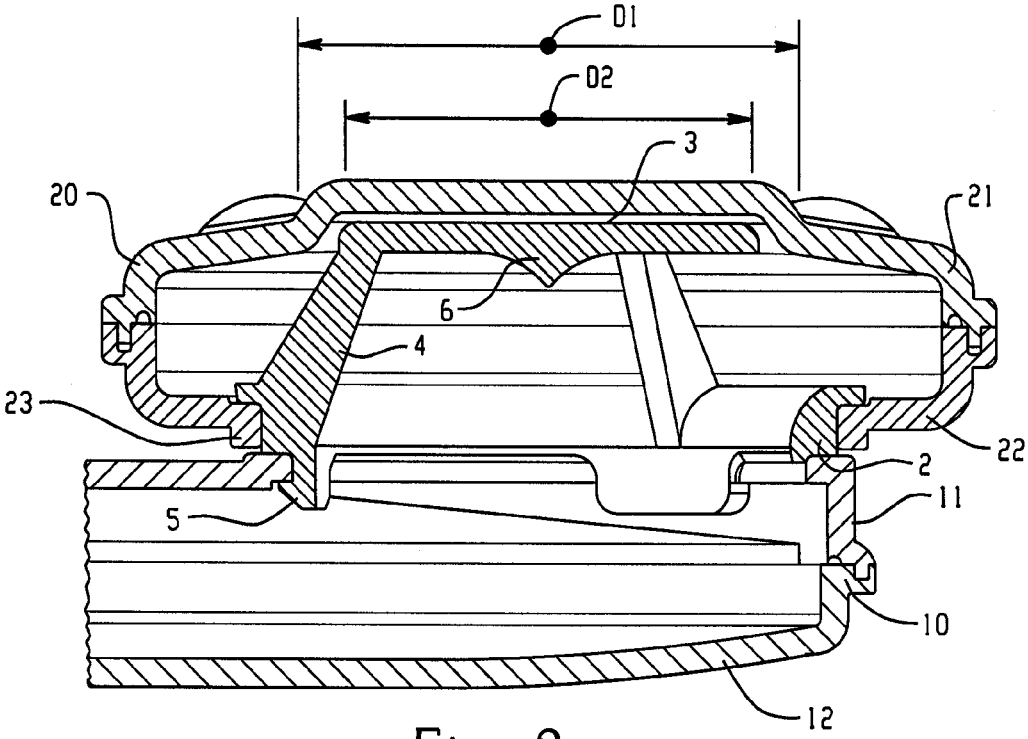
Fig. 2
Fig. 3
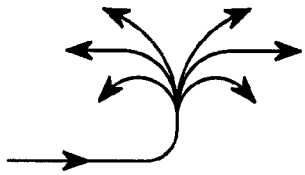

SPRAY ARM BEARING AND DISHWASHER WITH A SPRAY ARM ARRANGEMENT

FIELD OF THE INVENTION

The invention concerns a spray arm bearing for the rotatable support of a spray arm on a liquid feeding system.

BACKGROUND OF THE INVENTION

A conventional spray arm bearing includes a bearing ring with a bearing face or holder on which a spray arm is rotatably mounted. The bearing ring is connected to an impingement surface which deflects a stream of liquid flowing axially through the bearing ring from the axial to the radial direction, as a result of which the liquid flow enters the spray arm boom. The impingement surface is connected to the bearing ring so that the recoil is diverted by the deflection through the bearing ring and does not act on the spray arm itself. As a consequence the axial forces on the spray arm support system and the sticking and sliding friction is greatly reduced. During the production of a conventional spray arm bearing, the impingement area and the bearing ring are first produced separately and then joined together. Alternatively, an injection molding die is constructed in three parts of an upper plunger, a lower plunger and a slide. During the injection molding process, the slide is pushed into the space between the bearing ring and the impingement surface. After curing, the slide is pulled out simultaneously with the withdrawal of the upper and lower plungers from the intermediate space of the spray arm bearing. Both procedures are expensive since several operating steps or a complicated injection die are required.

BRIEF SUMMARY OF THE INVENTION

Therefore it is the object of the invention to design a spray arm bearing in such a way that it can be manufactured economically.

This problem is solved by the features of claim 1. Advantageous variants are the subject of the subordinate claims.

According to claim 1, the base area of a flow-guide device that causes a deflection of a flow of liquid from the axial to the radial direction is at most as large as the base area of a through-opening in a bearing element of the spray arm bearing. The outer contour of the base area of the flow-guide device is therefore at most equal in coverage to the base area of the through-opening or lies within the base area range of the through-opening. For example, if the base areas of the flow-guide device and of the through-opening are round, then the diameter of the flow-guiding devices is smaller than or equal to the diameter of the through-opening in the bearing element and bearing ring respectively.

Under this condition, an injection-molding die with only two injection molds and injection plungers can be used for the production of a one-piece spray arm bearing, i.e., in a single injection molding process. In this process, an injection plunger is steadily advanced from the bearing element side partway through the through-opening in the direction of the flow-guide device, while a counter-plunger is advanced from the direction of the flow-guide device which matches the outer contour of the plunger advanced through the through-opening. It is therefore neither necessary to join the flow-guide device and the bearing element together in a separate step nor to provide a gate valve for the injection molding die that has to be driven out sidewise after the injection (in the radial direction) from the opening zone between the flow-guide direction and bearing element. On the whole, therefore, fewer sharp edges are formed since fewer boundary surfaces are present between the injection dies, and the flow-guide device can be structured in the inside rotationally symmetrically in the three-dimensional direction, which would not be possible if a side slide gate were used with the injection molding die.

BRIEF DESCRIPTION OF THE DRAWINGS

One variant of the invention is explained in more detail by the figures. They show:

FIG. 1 is a perspective view of a spray arm bearing, and

FIG. 2 is the spray arm bearing of FIG. 1 connecting the inlet and a spray arm in the assembled state.

FIG. 3 shows schematic flow arrows to indicate a direction in which fluid is introduced to a guide cone and radially distributed by the guide cone.

DESCRIPTION OF EXAMPLE EMBODIMENTS

FIG. 1 shows a perspective view of a spray arm bearing 1. As shown in cross section in FIG. 2, the spray arm bearing 1 serves to connect an inlet 10 for supplying dishwashing liquid to a spray arm 20 that is rotatably mounted on the spray arm bearing 1. The spray arm bearing 1 includes a bearing ring 2 with a bearing surface on the outside, which is bounded in the axial direction (as shown in FIG. 1, top) by an annular projection 7. A roof 3, serving as a flow-guide device, is connected by crossbars 4 to the bearing ring 2. In the axial cross section, the crossbars 4 extend essentially in the radial direction while the width is minimized in the circumferential direction so that the crossbars 4 encounter a slight flow resistance of the liquid deflected in the radial direction. On the side opposite the roof 3, axially projecting stops 5 are arranged on the bearing ring 2 which the spray arm bearing engages in an exit opening in the inlet 10 (FIG. 2).

In rotational symmetry, a hyperbola-shaped or concavely formed guiding cone 6 extends from the inside of the roof 3. The guiding cone 6 serves to deflect dishwashing fluid entering essentially in the axial direction into the radial direction. The recoil caused by the deflection is absorbed by the roof 3 and passed on through the crossbars 4 to the bearing ring 2, which, in turn, is held firmly after being engaged/arrested at the inlet 10. As a result, the force exerted by the liquid inflow in the axial direction on the spray arm is minimized so that the friction of the spray arm 20 on the bearing surface of the bearing ring 2 is slight.

As FIG. 2 shows in cross section, the inlet 10 is made of two parts including an upper shell 11 and a lower shell 12. The upper shell 11 of the inlet 10 has a round exit opening for the dishwashing fluid which the catches 5 engage and thereby affix the spray arm bearing 1 to the inlet. As shown in FIG. 2, the dishwashing fluid moves from the left into the inlet 10 and is deflected at its right end through the opening into the axial direction and introduced into the spray arm 20.

The spray arm 20 is shown in cross section in FIG. 2, i.e. the booms of the spray arm run into and out of the plane of the drawing. The spray arm is made up of an upper shell 21 and a lower shell 22 and has on its inlet opening, through which the dishwashing liquid enters from the inlet 10, an inside surface which acts as a counter-bearing 23 to the outwardly lying bearing surface of the bearing ring 2. The flow arrows of FIG. 3 indicate highly schematically the inflow of the fluid from the left, the axial deflection and the subsequent radial distribution through the guide cone 6 of the roof 3, said guide cone 6 at first distributing it rotationally symmetrically, but the flow is guided around to the spray arm booms by the limitations of the spray arm interior space.

In the assembly of the spray arm 20, before connecting the upper shell 21 with the lower shell 22, the spray arm bearing 2 is inserted and the connection formed only then so that the spray arm bearing 1, although freely rotatable in the axial direction, is inserted inside the spray arm while maintaining a small clearance between the top of the roof 3 and the inside of the upper shell 21. The spray arm bearing 1 enclosed in the spray arm 20 is then arrested at the inlet 10. The bearing arrangement shown in FIG. 2 and with it the spray arm bearing 1 may be used in any bearing alignment, e.g., with a suspended bearing holder or an upright bearing holder of the spray arm.

To produce the one-part spray arm bearing 1 injection molding plungers are driven toward each other in the axial direction, see FIG. 1, a first plunger being moved axially from the direction of the roof 3 while a second plunger is moved axially from the direction of the bearing ring 2. The lower bearing plunger engages the bearing ring 2 through the through-opening, and its top side forms the surface of the guide cone 6 and an inwardly lying part of the crossbars 4. The upper counter-plunger forms with its end face the top side of the bearing ring 2 and of the roof 3 including part of the crossbars 4 to the extent that they protrude above the outer diameter of the roof 3. As FIG. 2 illustrates that the outer diameter D2 of the roof 3 is smaller than the limiting inner diameter D1 of the liquid through-opening of the bearing ring 2. In order to manage with a two-part injection molding die, the diameter D2 is smaller than or equal to the diameter D1.

REFERENCE SYMBOLS

1 Spray arm bearing
2 Bearing ring
3 Roof
4 Crossbar
5 Catch
6 Guide cone
7 Projection
10 Inlet
11 Upper shell
12 Lower shell
20 Spray arm
21 Upper shell
22 Lower shell
23 Counter-bearing

What is claimed is:

1. A spray arm bearing (1) with a bearing element (2) for mounting a spray arm (20), a flow-guide device (3) and at least one crossbar (4) extending between the bearing element (2) and the flow-guide device (3) to couple the flow-guide device to the bearing element (2), whereby the bearing element (2) comprises a through-opening for the passage of a fluid, wherein the bearing element (2), the at least one crossbar (4) and the flow-guide device (3) are integrally formed as a one-piece unit to be installed on a dishwasher and that a base area (D2) of the flow-guide device (3) corresponds to a base area (D1) of the through-opening or lies within the base area (D1) of the through-opening.

2. The spray arm bearing as in claim 1, in which the flow-guide device (3) and the through-opening have a round base area and the diameter (D2) of the flow-guide device is smaller than or equal to the diameter (D1) of the through-opening of the bearing element (2).

3. The spray arm bearing as in claim 1, wherein when viewed in an axial cross section, the at least one crossbar (4) extends in a radial direction to a greater extent than in a width direction to minimize flow resistance encountered by the fluid traveling toward the flow-guide device (3).

4. The spray arm bearing as in claim 1, in which the bearing element (2) has at least one catching element (5) for engaging the bearing element on a liquid inlet (10).

5. The spray arm bearing as in claim 1, in which the flow-guide device (3) has a guiding surface (6) for deflecting a fluid flowing axially toward an axis of rotation into a radial direction.

6. The spray arm bearing as in claim 5, in which the guiding surface (6) is rotationally symmetrical and is concavely curved from a center in the radial direction.

7. A spray arm arrangement for a dishwashing machine, the spray arm arrangement comprising: a liquid inlet (10), a spray arm bearing (1) connected to the liquid inlet (10), wherein the spray arm bearing (1) includes a bearing element (2), a flow-guide device (3) and at least one crossbar (4) extending between the bearing element (2) and the flow-guide device (3) to couple the flow-guide device to the bearing element (2), whereby the bearing element (2) comprises a through-opening for the passage of a fluid, wherein the bearing element (2), the at least one crossbar (4) and the flow-guide device (3) are integrally formed as a one-piece unit and that a base area (D2) of the flow-guide device (3) corresponds to a base area (D1) of the through-opening or lies within the base area (D1) of the through-opening, and a spray arm (20) mounted to the bearing element (2) of the spray arm bearing (1).

8. The spray arm arrangement as in claim 7, in which the spray arm bearing (1) is affixed as a separate element to the liquid inlet (10).

9. A dishwashing machine including the spray arm arrangement of claim 7.

10. The spray arm bearing as in claim 3, wherein the at least one cross bar comprises at least three crossbars.

11. A spray arm bearing (1) with a bearing element (2) for mounting a spray arm (20) and a flow-guide device (3) connected to the bearing element (2), the flow-guide device (3) comprising a guiding surface (6) that is rotationally symmetrical and is concavely curved from a center in the radial direction for deflecting a fluid flowing axially toward an axis of rotation into a radial direction, whereby the bearing element (2) comprises a through-opening for the passage of fluid, characterized in that the base area (D2) of the flow-guide device (3) corresponds to the base area (D1) of the through-opening or lies within the base area (D1) of the through-opening.

* * * * *